US010135118B2

(12) United States Patent
Szini et al.

(10) Patent No.: US 10,135,118 B2
(45) Date of Patent: Nov. 20, 2018

(54) ADAPTIVE PARASITIC MULTI-ANTENNA SYSTEM

(71) Applicant: Motorola Mobility LLC, Chicago, IL (US)

(72) Inventors: Istvan Szini, Grayslake, IL (US); Krishna Bellamkonda, McKinney, TX (US); Christopher Janonis, Arlington Heights, IL (US)

(73) Assignee: Motorola Mobility LLC, Chicago, IL (US)

( * ) Notice: Subject to any disclaimer, the term of this patent is extended or adjusted under 35 U.S.C. 154(b) by 239 days.

(21) Appl. No.: 15/254,865

(22) Filed: Sep. 1, 2016

(65) Prior Publication Data

US 2018/0062242 A1 Mar. 1, 2018

(51) Int. Cl.

| | |
|---|---|
| ***H01Q 1/24*** | (2006.01) |
| ***H01Q 5/392*** | (2015.01) |
| ***H01Q 3/24*** | (2006.01) |
| ***H01Q 5/385*** | (2015.01) |

(52) U.S. Cl.
CPC ..... *H01Q 1/243* (2013.01); *H01Q 3/24* (2013.01); *H01Q 5/385* (2015.01); *H01Q 5/392* (2015.01)

(58) Field of Classification Search
CPC ..... H01Q 1/243; H01Q 5/392
See application file for complete search history.

(56) References Cited

U.S. PATENT DOCUMENTS

2013/0189928 A1* 7/2013 Desclos ..... H01Q 1/243 455/63.4

* cited by examiner

*Primary Examiner* — Graham Smith
(74) *Attorney, Agent, or Firm* — Cygan Law Offices P.C.; Joseph T. Cygan

(57) ABSTRACT

An apparatus includes a first antenna and a second antenna, operatively coupled to a transceiver; at least one parasitic resonator; and parasitic selection logic, operatively coupled to the at least one parasitic resonator and to the transceiver. The parasitic selection logic operative is to determine a signal quality metric using a first signal quality metric measurement for the first antenna, and a second signal quality metric measurement for the second antenna; and switch the at least one parasitic resonator to a termination in response to the determined signal quality metric.

15 Claims, 11 Drawing Sheets

| SNR-Quantization | Ant_Corr=0.1 | Ant_Corr=0.2 | Ant_Corr=0.3 | Ant_Corr=0.4 | Ant_Corr=0.5 | Ant_Corr=0.6 | Ant_Corr=0.7 | Ant_Corr= 0.8 | Ant_Corr =0.9 |
|---|---|---|---|---|---|---|---|---|---|
| Level_1 (-2 dB to 4dB) | 100 | 98.26 | 96.53 | 94.79 | 93.06 | 92.59 | 92.13 | 91.67 | 91.67 |
| Level_2 (4 dB to 6 dB) | 100 | 98.75 | 97.5 | 96.25 | 95 | 94.67 | 94.33 | 94 | 94 |
| Level_3 (6 dB to 8dB) | 100 | 96.69 | 93.38 | 90.07 | 86.76 | 85.05 | 83.33 | 81.62 | 81.62 |
| Level_4 (8 dB to 10 dB) | 100 | 98.91 | 97.83 | 96.74 | 95.65 | 91.1 | 86.54 | 81.99 | 81.99 |
| Level_5 (10 dB to 12 dB) | 100 | 98.52 | 97.04 | 95.56 | 94.09 | 91.58 | 89.07 | 86.56 | 86.56 |
| Level_6 (12 dB to 16 dB) | 100 | 99.17 | 98.35 | 97.52 | 96.7 | 94.34 | 91.98 | 89.62 | 89.62 |

*FIG. 11*

ADAPTIVE PARASITIC MULTI-ANTENNA SYSTEM

FIELD OF THE DISCLOSURE

The present disclosure relates generally to antennas and multiple-input, multiple-output (MIMO) antennas systems with diversity reception, and more particularly to mobile devices employing such MIMO antenna systems.

BACKGROUND

Mobile devices may incorporate multiple antennas, or an antenna array, for diversity reception and for implementing spatial multiplexing. Spatial multiplexing involves splitting a high data rate signal into two or more separate data streams that are intended to arrive at a receiver antenna array with different spatial signatures such that the two or more separate data streams can be reassembled to construct the high data rate signal. At least two separate mobile device antennas, or two antenna elements of an antenna array, each receive one of the separate data streams. Therefore, spatial multiplexing may be considered a form of antenna diversity reception.

The goal of antenna diversity reception is to take advantage of decorrelation between the diversity antennas. The decorrelation may be achieved by physical placement, polarization or by using differing antenna beam patterns. Mobile device diversity and MIMO (multiple-input, multiple-output) antenna systems have been developed based on static figure-of-merit ("FoM") requirements, total efficiency, gain imbalance and envelope correlation coefficient values (i.e. antenna correlation) that are fixed regardless of prevalent operating parameters or the environment in which the mobile device is operating.

Performance of the MIMO system may be negatively impacted by changes in the radiated channel conditions and the user's position and handgrip on the mobile device, because the hand position may impair radio frequency (RF) reception by the MIMO antennas. For this and other reasons, challenges exist for achieving good performance of diversity antenna systems in a mobile device.

BRIEF DESCRIPTION OF THE DRAWINGS

FIG. 11 is an example table relating antenna correlation to SNR quantized values.

DETAILED DESCRIPTION

Figure 1:
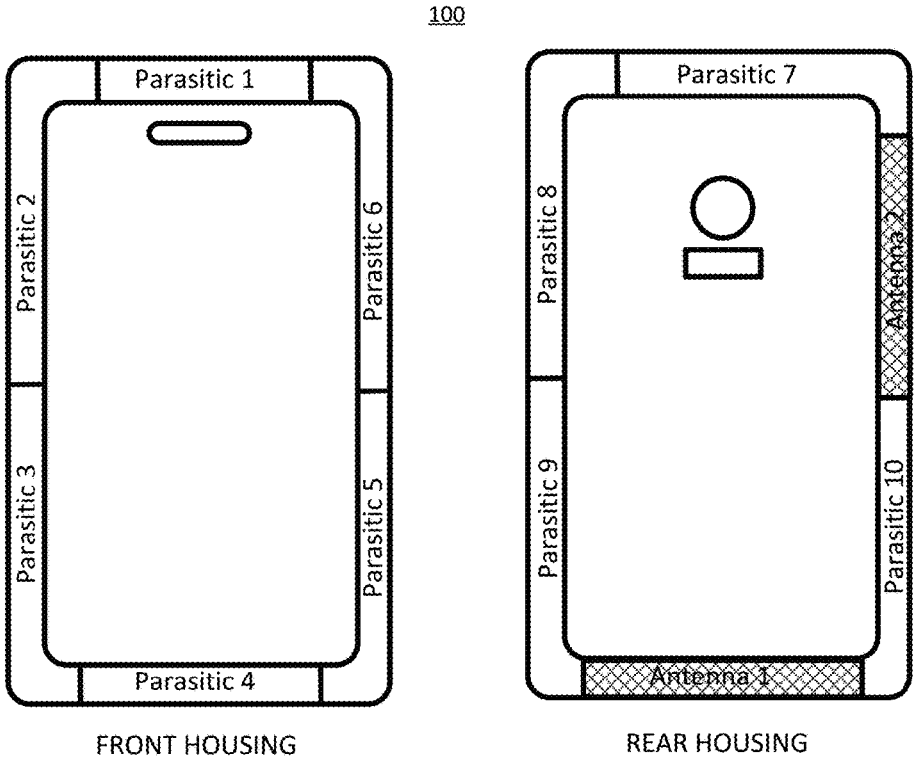
FIG. 1 is a diagram of a mobile device that has at least two antennas and an array of parasitic resonators positioned about the mobile device in accordance with an embodiment.

Briefly, the disclosed embodiments provide apparatuses and methods that obtain real time performance measurements and adaptively configure parasitic resonators, in response to the real time performance measurements, to improve MIMO antenna performance under given conditions. In some embodiments, the apparatuses and methods may prioritize envelope correlation over antenna efficiency and gain imbalance, or vice versa, based on the real time performance measurements.

One disclosed apparatus includes a first antenna and a second antenna, operatively coupled to a transceiver; at least one parasitic resonator; and parasitic selection logic, operatively coupled to the at least one parasitic resonator and to the transceiver. The parasitic selection logic is operative to determine a signal quality metric using a first signal quality metric measurement for the first antenna, and a second signal quality metric measurement for the second antenna; and switch the at least one parasitic resonator to a termination in response to the determined signal quality metric.

The apparatus may further include a set of terminations that are operatively coupled to the parasitic selection logic, where the parasitic selection logic is operative to switch the parasitic resonator to a specific termination of the set of terminations. The apparatus may further include a termination switch that is operatively coupled to at least one parasitic resonator, and to a set of terminations, where the parasitic selection logic is operative to control the termination switch to connect the parasitic resonator to a specific termination. In some embodiments, the termination switch may be operatively coupled to the parasitic selection logic. In other embodiments, the parasitic selection logic may include the termination switch.

Another disclosed apparatus includes a first antenna and a second antenna, operatively coupled to a transceiver; a set of parasitic resonators distributed about the apparatus; and parasitic selection logic, operatively coupled to the set of parasitic resonators and to the transceiver. The parasitic selection logic is operative to determine a signal quality metric using a first signal quality metric measurement for the first antenna, and a second signal quality metric measurement for the second antenna; and configure the set of parasitic resonators such that each parasitic resonator is coupled to a corresponding termination in response to the determined signal quality metric.

The apparatus may include a termination matrix that is operatively coupled to the parasitic selection logic, and that includes termination sets where each termination set corresponds to a parasitic resonator in the set of parasitic resonators, and where the parasitic selection logic is operative to switch each parasitic resonator to a specific termination of a corresponding termination set in response to the determined signal quality metric.

In some embodiments, the apparatus may include a termination switching matrix that is operatively coupled to the termination matrix, where the parasitic selection logic is operative to control the termination switching matrix to switch each individual parasitic resonator, of the set of parasitic resonators, to a specific termination of a corresponding termination set in response to the determined signal quality metric. In some embodiments, the termination switching matrix may be operatively coupled to the parasitic selection logic. In other embodiments, the parasitic selection logic may include the termination switching matrix.

In some embodiments, each termination set of the termination switching matrix may include an open circuit termination, a short circuit termination, and at least one termination of known impedance. In some embodiments, the at least one termination of known impedance is a fifty Ohm termination.

In some embodiments, the parasitic selectin logic is further operative to determine a dominant figure-of-merit for the first antenna and the second antenna, where the dominant figure-of-merit is determined from at least two figure-of-merit types related to performance of the first antenna when paired with the second antenna. The parasitic selection logic is also operative to configure the set of parasitic resonators, to obtain the dominant figure-of-merit, in response to a signal quality metric's relationship to the at least two figure-of-merit types.

In some embodiments, the parasitic selectin logic is further operative to obtain the signal quality metric using a first signal quality metric measurement for the first antenna, and a second signal quality metric measurement for the second antenna; and determine the dominant figure-of-merit based on the signal quality metric's relation to an inflection point in a relationship of signal-to-noise ratio and data throughput to the figure-of-merit types, where signal-to-noise ratio above the inflection point indicates configuration of the set of parasitic resonators such that the first antenna and the second antenna, when paired, have a first figure-of-merit type as the dominant figure-of-merit and where signal-to-noise ratio below the inflection point indicates configuration of the set of parasitic resonators such that the first antenna and the second antenna, when paired, have a second figure-of-merit type as the dominant figure-of-merit.

In some embodiments, the parasitic selectin logic is operative to configure the set of parasitic resonators, by switching at least one of the parasitic resonators to a termination such that the first antenna and the second antenna have a lower antenna correlation when antenna correlation is the dominant figure of merit; and by switching at least one of the parasitic resonators to a termination such that the first antenna and the second antenna have a lower gain imbalance when gain imbalance is the dominant figure of merit.

In some embodiments, the parasitic selectin logic is further operative to determine that antenna correlation is the dominant figure-of-merit when the signal quality metric is above the inflection point; and determine that gain imbalance is the dominant figure-of-merit when the signal quality metric is below the inflection point.

In some embodiments, the parasitic selectin logic is further operative to calculate the signal quality metric using signal-to-noise ratios obtained for each antenna. Some embodiments may also include condition prediction logic, that is operatively coupled to the parasitic selection logic, where the parasitic selection logic is further operative to obtain a prediction of the signal quality metric from the condition prediction logic, based on user history, and preselect a parasitic resonator configuration in response to the prediction.

Some embodiments may further include a correlation estimator that is operatively coupled to the transceiver and to the parasitic selection logic. The correlation estimator is operative to obtain a channel quality indicator (CQI) measurement for the first antenna and the second antenna; determine a composite CQI for the two antennas; and estimate the antenna correlation for the first antenna and second antenna using the composite CQI; such that the parasitic selection logic is operative to configure the set of parasitic resonators in response to the estimated antenna correlation.

The various embodiments may include non-volatile, non-transitory memory, operatively coupled to the correlation estimator, that stores a CQI table mapping composite CQI including at least a first and second multiple input multiple output (MIMO) stream to coding rates, such that the correlation estimator is operative to obtain the antenna correlation estimate by performing a table lookup operation in the CQI table using the composite CQI.

In some embodiments, the correlation estimator is further operative to obtain a signal-to-noise ratio (SNR) measurement for the first antenna and the second antenna; and estimate the antenna correlation for the first antenna and second antenna using the composite CQI and the SNR measurement. In some embodiments, the correlation estimator may be further operative to provide a feedback signal to the parasitic selection logic based on the estimated antenna correlation. The parasitic selection logic is operative to: configure the set of parasitic resonators, in response to the feedback signal.

Turning now to the drawings wherein like numerals represent like components, FIG. 1 is a diagram of an example mobile device 100 having at least two antennas (antenna 1 and 2), and a group of parasitic resonators (parasitic 1 through 10) positioned about the mobile device 100. In the example of FIG. 1, parasitic resonators are shown positioned about the perimeter of the front housing section and rear housing section of mobile device 100. Although the example mobile device 100 includes ten parasitic resonators, a mobile device may have more than ten, or less than 10, parasitic resonators in various embodiments.

The two antennas of the mobile device 100 may be used as MIMO antennas and are part of a MIMO antenna system which may include several antennas. In one example embodiment, the two antennas shown may provide low correlation, for example by being orthogonally polarized with respect to the each other, and may provide high gain imbalance. The terms "antenna correlation" (also "correlation") and "gain imbalance" are also each referred to herein individually as a "figure-of-merit" or as a "figure-of-merit type." In other words, "antenna correlation" is one example of a figure-of-merit or figure-of-merit type and "gain imbalance" or "Branch Power Ratio" is another example of a figure-of-merit or figure-of-merit type.

As understood by those of ordinary skill, it is preferable to have low correlation and low gain imbalance however a tradeoff must be made in any design because of limitations related to MIMO antenna system placement, user head and hand effect, mismatch and insertion losses, source-pull complex mismatch, among other design restrictions imposed on a mobile device. It is to be understood that FIG. 1 is an example only and that the actual positions of the two antennas may be different, in accordance with the embodiments, from the example shown in FIG. 1. Specifically, the actual positions and/or configurations of the antennas may differ with respect to each other, however the antennas may be positioned and configured as noted above regarding the tradeoff between correlation and gain imbalance.

The terms "high" and "low" as used herein are relative terms that are to be construed such that a given pair of MIMO antennas exhibits a "better" or "worse" performance when used together under certain conditions, by comparison of measured performance values for the pair under different conditions, but irrespective of the actual numerical range of any such measured performance value. More particularly, a first MIMO antenna pair exhibiting a "low" correlation is herein considered as exhibiting a "better" correlation than the same MIMO antenna pair exhibiting a "high" correlation (i.e. "worse" performance). A MIMO antenna pair exhibiting a "low" gain imbalance is herein considered as exhibiting a "better" gain imbalance than the same MIMO antenna pair exhibiting a "high" gain imbalance (i.e. "worse" performance). Therefore, by comparison of correlation and gain imbalance measurements for a MIMO antenna pair, one setting of parasitic resonators may be found to cause the MIMO antenna pair to have a "high" or "higher" correlation and a "low" or "lower" gain imbalance, while a second, different setting of parasitic resonators may be found to cause the MIMO antenna pair to have a "low" or "lower" correlation and a "high" or "higher" gain imbalance with respect to each other by the comparison.

The two antennas are operative to form a MIMO antenna pair to obtain spatially multiplexed signals. That is, the two antennas are operative to receive a transmission that includes a first stream and a second stream. In a long term evolution (LTE) 4G system, the first stream and second stream are referred to as layers such that the transmission is a rank 2 transmission based on it having two layers, i.e. the first stream and second stream. Thus for a rank 2 transmission two codewords may be received by the mobile device 100 when a single codeword is mapped to a single layer. In LTE operation, an open loop feedback system is utilized in which a mobile device calculates CQI based on defined algorithms and based on the rank of the transmission. The CQI information may be sent as feedback to the transmitting base station for further adjustments of the transmitted streams.

Figure 2:
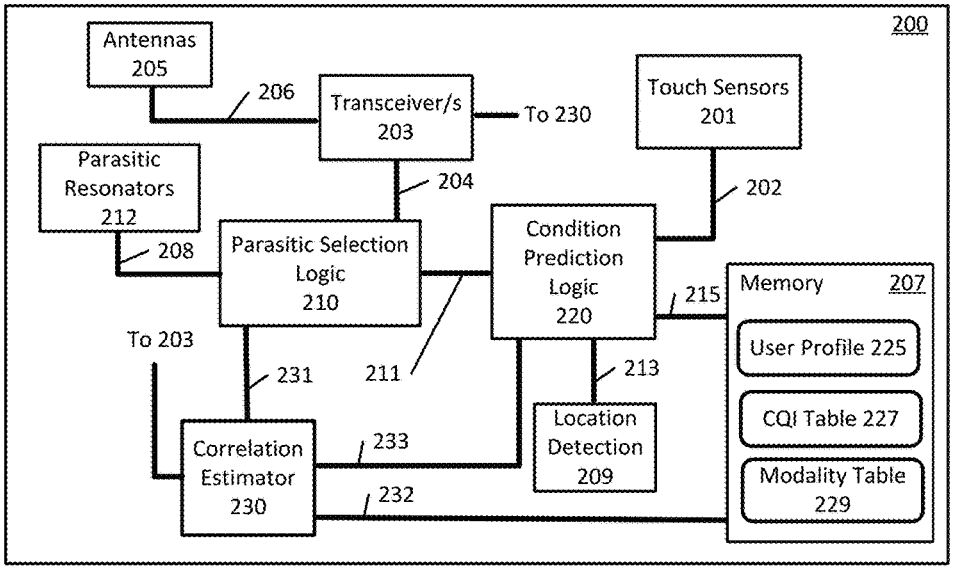
FIG. 2 is a block diagram of an example mobile device having multiple-input/multiple-output (MIMO) antennas and parasitic selection logic in accordance with an embodiment.

FIG. 2 is a block diagram of a mobile device 200 that has multiple-input/multiple-output (MIMO) antennas and parasitic selection logic, and is one example apparatus in accordance with an embodiment. In accordance with the embodiments, the mobile device 200 may predict its environmental SNR, and/or other conditions, such as, but not limited to, CQI, and trigger MIMO antenna adaptation by using parasitic resonators 212 in response to such predictions.

The mobile device 200 includes a MIMO antenna system 205 that includes at least two antennas that are operatively coupled to transceivers 203 by RF coupling 206. The "RF coupling" may include, but is not limited to, transmission lines and matching networks, duplexers, quadplexers, bandpass filters, RF connectors, etc., as required by the antenna bandwidth requirements and physical design constraints of the mobile device 200 housing, etc. For example, the transmission lines may be implemented using microstrip, stripline or any suitable RF circuit technology as understood by those of ordinary skill and may include transmission line elements such as capacitances or inductances, discrete components, or combinations thereof as needed to implement matching networks between the various components. In some embodiments, the MIMO antenna system 205 may include one or more antenna arrays. Each antenna array may be evaluated by a FoM or by signal quality metrics.

A group of parasitic resonators 212 are operatively coupled to parasitic selection logic 210 by control lines 208. The parasitic selection logic 210 is operatively coupled to the transceivers 203 by one or more data lines 204 which provide measurement data used for making selection decisions. The parasitics may be "activated" by the parasitic selection logic 210 by switching terminations individually, or in combination, to one or more parasitic resonators. For example, the parasitic resonators 212 may be considered to be a parasitic array, with each individual parasitic resonator being switchable between various terminations such as, but not limited to, short, open, 50 ohm, etc.

The mobile device 200 also includes a set, or an array, of touch sensors 201 that are positioned about the mobile device 200 housing and that are operative to sense the user's fingers and hand when the user grips the mobile device 200 housing. The touch sensors 201 may be, but are not limited to, infrared ("IR") touch sensors, capacitive touch sensors, or combinations thereof. The touch sensors 201 are operatively connected to condition prediction logic 220 by coupling 202 and provide sensor outputs to the condition prediction logic 220 (as inputs). The condition prediction logic 220 may also be operatively coupled to location detection logic 209 by coupling 213 such that the condition prediction logic 220 is operative to receive location data. The condition prediction logic 220 is operatively coupled to memory 207 by read/write connection 215 such that the condition prediction logic 220 may read from, and write to, a user profile 225 stored in the memory 207. The memory 207 is a non-volatile, non-transitory memory.

The condition prediction logic 220 is operatively coupled to the parasitic selection logic 210 by coupling 211 to send condition prediction data to the parasitic selection logic 210. For example, the condition prediction logic 220 receives sensor data from the touch sensors 201 and may determine the position of the user's fingers and hand on the mobile device 200 housing. Because the user's hand position may cause impairment to RF reception by the MIMO antennas, the condition prediction logic 220 may predict that a "low" or "high" SNR condition will result and may send a flag ("low" SNR predict flag or "high" SNR predict flag) to the parasitic selection logic 210. The parasitic selection logic 210 may then use the prediction to switch one or more of the parasitic resonators 212 as appropriate, to an initial setting to adjust the condition (i.e. prior to determination of the actual SNR condition).

In some embodiments, the condition prediction logic 220 may obtain additional data, in addition to data received from the touch sensors 201, and may create a user profile 225 that includes the obtained data for use in predictions. For example, the condition prediction logic 220 may collect user history for data call and voice calls including time stamps and location data stamps and store this history information in the user profile 225. The condition prediction logic 220 may also obtain SNR measurement data from the parasitic selection logic 210, for these data calls and voice calls. Based on past activities, the condition prediction logic 220 may therefore then predict the SNR based on past SNR measurements associated with these past activities by reading the user profile 225. For example, if the user profile 225 data shows that the user routinely makes a data call at 3:00 pm on a certain day and time, and at a certain location, and the measured SNR indicated selection of a certain one or more parasitic resonators 212, then the condition prediction logic 220 will make this prediction determination and will send the appropriate SNR predict flag to the parasitic selection logic 210. In this way, the one or more parasitic resonators appropriate for the predicted condition can be selected in advance which enhances the mobile device 200 performance and the user's experience with the device.

A correlation estimator 230 is operatively coupled to the memory 207 by a read connection 232 to access and read a CQI table 227 and, in some embodiments, a modality table 229. The condition prediction logic 220 is operatively coupled the correlation estimator by coupling 233 to provide a modality-predict flag. The modality-predict flag may be used to perform a lookup operation in the modality table 229 for values mapped to given modalities by empirical measurements. The correlation estimator 230 may obtain a predicted antenna correlation by using the CQI table 227, and send a feedback signal 231 to the parasitic selection logic 210. The correlation estimator is also operatively coupled to the transceiver/s 203 to obtain SNR and CQI information for two or more MIMO streams. The correlation estimator 230 estimates antenna correlation using values obtained from the transceivers 203 and by using the CQI table 227.

As discussed above with respect to FIG. 1, in LTE operation, an open loop feedback system is utilized in which mobile device 200 calculates CQI based on defined algorithms and based on the rank of the transmission. The CQI information may be sent as feedback to the transmitting base station for further adjustments of the transmitted streams. The correlation estimator 230 is operatively coupled to the transceivers 203 to obtain signal quality metrics including signal-to-noise-ratio (SNR) and CQI information. The correlation estimator 230 uses the SNR and CQI information in conjunction with the CQI table 227 that may be stored in memory 207. Memory 207 is non-volatile, non-transitory memory and is either operatively coupled to the correlation estimator 230 (via read connection 232) or is integrated into the correlation estimator 230. The correlation estimator 230 is operative to determine an effective SNR and an effective CQI using the SNR and CQI information obtained from the transceivers 203. These values are then used by the correlation estimator 230 to determine a "MIMO conditioner" metric that is used to perform a table lookup operation using the CQI table to obtain a corresponding antenna correlation value. In other words, the correlation estimator 230 is operative to estimate antenna correlation for the operating antennas of the MIMO antenna system 205. This estimated correlation may then be used to generate an appropriate closed loop feedback signal to the parasitic selection logic 210 to improve antenna correlation (or antenna gain) for the existing transmission being received.

In some embodiments, the memory 207 may also store the modality table 229. The modality table maps various pretested uses case modalities using antennas of known correlation, such as various handgrips, positions of the mobile device 200 with respect to a user's head, dock mode, concealed mode, etc., so as to map these modalities to changes in SNR and CQI information. This mapping may then be used to anticipate antenna correlation changes and adjust accordingly by selecting one or more appropriate parasitic resonators. For example, the correlation estimator 230 may receive sensor data from the touch sensors 201 and use the sensor data to determine the modality. The correlation estimator 230 may then obtain SNR and CQI information from the modality table 229, and antenna correlation from the CQI table. In other words, the correlation estimator 230 estimates the antenna correlation using the predetermined CQI table 227 and may provide the feedback signal 231 to the parasitic selection logic 210 for the purpose of making parasitic array adjustments to achieve, for example, low antenna correlation or other performance improvements to the extent possible.

Figure 3:
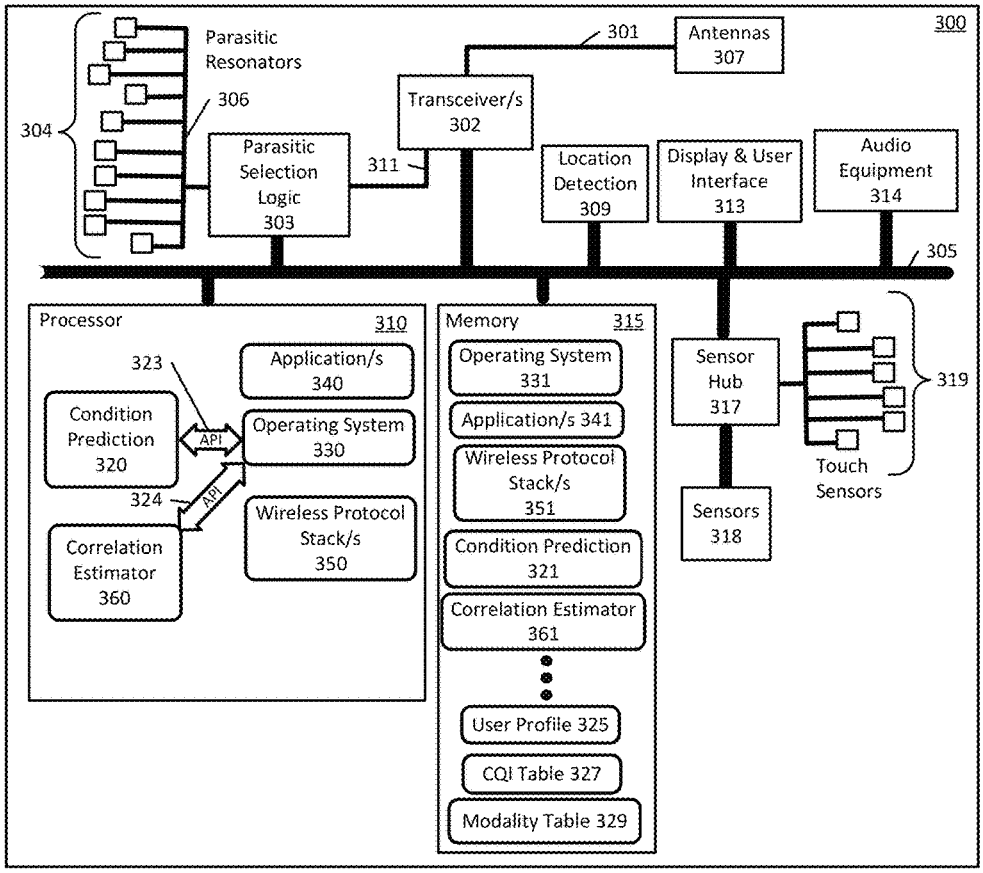
FIG. 3 is a block diagram of another example mobile device having multiple-input/multiple-output (MIMO) antennas and parasitic selection logic in accordance with an embodiment.

In FIG. 3, mobile device 300, which is another example apparatus, includes parasitic selection logic 303 operatively coupled to an array of parasitic resonators 304 by control coupling 306. The parasitic selection logic 303 is operatively coupled to at least one internal communication bus 305 and to transceivers 302 by data coupling 311 which provides measurement data used for making parasitic resonator selection decisions. The least one internal communication bus 305 provides operative coupling between the various components of the mobile device 300 include the parasitic selection logic 303 and the transceivers 302. Each of the various components of the mobile device 300 that are operatively coupled to the communication bus 305 may accordingly send information to, or receive information from, a processor 310. In addition to the processor 310, transceivers 302, and parasitic selection logic 303, the mobile device 300 components also include, but are not limited to, MIMO antenna system 307, location detection logic 309 (such as, but not limited to, a GPS receiver), display and user interface 313, audio equipment 314, memory 315, and a sensor hub 317.

The sensor hub 317 is operatively coupled to a plurality of sensors 318 which may include thermal sensors, proximity sensors, accelerometers, gyroscopic sensors, light sensors, etc. The sensor hub 317 is also operatively coupled to a set of touch sensors 319 which are positioned about the housing of the mobile device 300 and which are operative to sense the user's hand and fingers when placed upon the housing, and to send data to the sensor hub 317. The touch sensors 319 may be optical sensors, capacitive sensors, or combinations of both. The sensor hub 317 is a low power processor that offloads the processor 310 from some tasks such as obtaining data from the sensors 318 and from touch sensors 319. The sensor hub 317 may provide functions while the processor 310 is placed in a sleep mode in order to conserve mobile device 300 battery power. The sensor hub 317 is operative to receive data from the various sensors and to convey the data to the processor 310 over the internal communication bus 305. The data is therefore related to the mobile device 300 modality at any given point in time.

Similar to the mobile device 200 in FIG. 2, the mobile device 300 includes MIMO antenna system 307 which may include various MIMO antennas and/or antenna arrays. The MIMO antenna system 307 is operatively coupled to the transceivers 302 by RF coupling 301. In some embodiments, the MIMO antenna system 307 may include one or more antenna arrays. Each antenna array may be evaluated by a FoM or by signal quality metrics for the antenna array.

The processor 310 is operative to execute executable instructions (also referred to as "executable code" or "code") stored in memory 315, including operating system executable code 331 to run at least one operating system 330, wireless protocol stack code 351 to run one or more wireless protocol stacks 350, and application (or "user space") executable code 341 to run one or more applications 340. In accordance with the embodiments, the processor 310 is also operative to execute condition prediction code 321 to implement condition prediction logic 320, and to execute correlation estimator code 361 to implement correlation estimator 360.

The condition prediction logic 320 may interact and communicate with the operating system 330 by one or more APIs of a suite of APIs 323 (application programming interfaces) or by other appropriate operative coupling. The condition prediction logic 320 is operative to communicate with the sensor hub 317 to obtain data from the touch sensors 319, the sensors 318 or combinations thereof. This modality data may include information about the position of the mobile device 300, such as whether the mobile device 300 is stationary, in a docking station, placed flatly on a table surface, etc. and other information related to the ambient environment surrounding the mobile device 300. The location detection logic 309 may also be accessed by the condition prediction logic 320 to obtain location information for the mobile device 300. The condition prediction logic 320 may collect and aggregate this data into a user profile 325 stored in memory 315.

The data contained in the user profile 325 is time and date stamped and geotagged using location data from the location detection logic 309. The operation of the condition prediction logic 320 is similar to the condition prediction logic 220 operation described with respect to FIG. 2. That is, the condition prediction logic 320 may obtain data from the touch sensors 319 and from position sensors and other sensors or sensors 318, and may create the user profile 325 that includes the obtained data for use in predictions. In the example mobile device 300, the condition prediction logic 320 may obtain SNR (or SINR) measurement data from the parasitic selection logic 303 over the internal communication bus 305, or may obtain this data directly from the transceivers 302.

The correlation estimator 360 communicates with the operating system 330 using an API 324, and is operative to obtain SNR and CQI measurements from the transceiver/s 302 for at least two MIMO streams in a rank 2 transmission. The correlation estimator 360 may access a CQI table 327 stored in memory 315, and also a modality table 329 in some embodiments. The correlation estimator 360 is operative to determine the MIMO conditioner metric discussed above and estimate the antenna correlation of the mobile device 300 while in any of various modalities. The correlation estimator 360 may provide feedback information to the parasitic selection logic 303 so that adjustments may be made, by activating one or more parasitic resonators, to improve the antenna correlation under a given modality.

In some embodiments, the correlation estimator 360 may interact with the condition prediction logic 320 to obtain predicted modality information and may send feedback to the parasitic selection logic 303 based on these predictions by accessing a modality table 329 and a CQI table 327 and obtaining an expected antenna correlation for the predicted modality.

It is to be understood that any of the above described software components (i.e. executable instructions or executable code) in the example mobile device 300, as well as any of the above described components of example mobile device 200, may be implemented as software or firmware (or a combination of software and firmware) executing on one or more processors, or using ASICs (application-specific-integrated-circuits), DSPs (digital signal processors), hardwired circuitry (logic circuitry), state machines, FPGAs (field programmable gate arrays) or combinations thereof. Therefore the mobile devices illustrated in the drawing figures described herein provide examples of a mobile device and are not to be construed as a limitation on the various other possible mobile device implementations that may be used in accordance with the various embodiments.

More particularly, parasitic selection logic, condition prediction logic and/or the correlation estimator may be a single component or may be implemented as any combination of DSPs, ASICs, FPGAs, CPUs running executable instructions, hardwired circuitry, state machines, etc., without limitation. Therefore, as one example, the parasitic selection logic may be implemented using an ASIC or an FPGA. In another example, the parasitic selection logic may be a combination of hardware for implementation of changing impendence terminations between one or more parasitic resonators, and software or firmware executed by a processor that makes the decision regarding when to engage a given parasitic resonator, etc. These example embodiments and other embodiments are contemplated by the present disclosure.

Figure 4:
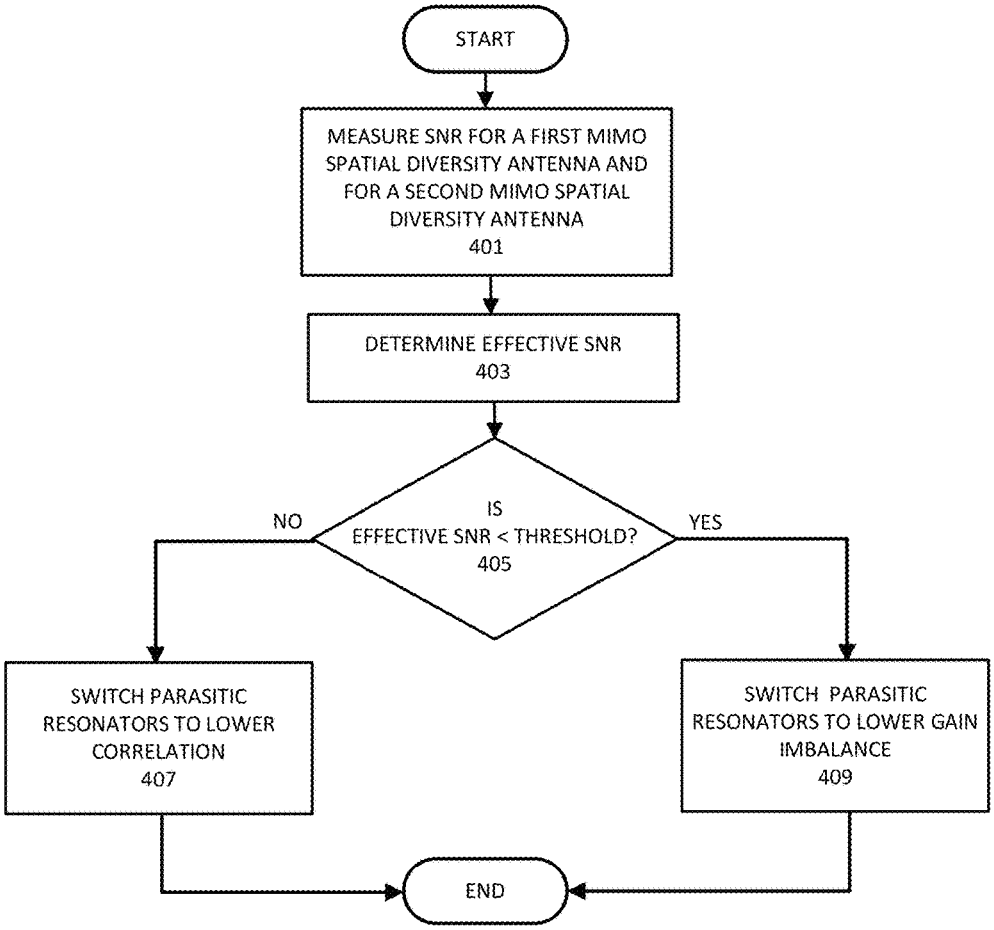
FIG. 4 is a flow chart of an example method of operation of the mobile device shown in FIG. 2 or 3.

FIG. 4 is a flowchart that illustrates a method of operation of a mobile device, such as mobile device 200 in FIG. 2, or mobile device 300 in FIG. 3. Referencing the embodiment of mobile device 200 for convenience, the method of operation begins and in operation block 401, the parasitic selection logic 210 determines a signal quality metric, such as signal-to-noise ratio (SNR) or signal-to-interference-plus-noise-ratio (SINR), for a signal obtained using the MIMO antenna system 205, which may be obtained in conjunction with one or more switched parasitic resonators. More specifically, the parasitic selection logic 210 measures SNR or SINR for a first MIMO antenna and a second MIMO antenna of a MIMO antenna pair. In operation block 403, the parasitic selection logic 210 determines an effective SNR based on the measurements conducted in operation block 401. The effective SNR may then be calculated as an average SNR or as a weighted mean.

As a further example, if the first MIMO antenna is represented by "ant0" and the second MIMO antenna is represented by "ant1," then an effective SINR may be calculated as: $SINReff=[(wt1\times SINR(ant0))+(wt2\times SINR(ant1))]$; where "wt1" and "wt2" are weighting factors calculated by statistical correlation of SINR(ant0) to effective CQI (channel quality indicator) and SINR(ant1) to effective CQI using empirical data collected using reference MIMO antennas with known antenna correlation.

In decision block 405, if the effective SNR (or effective SINR) is above a threshold, then the method of operation proceeds to operation block 407. In operation block 407, the parasitic selection logic 210 provides control signals over control lines 208, to switch terminations of one or more parasitic resonators to achieve low correlation and high gain imbalance. The method of operation then ends.

If the effective SNR is below the threshold in decision block 405, then the method of operation proceeds to operation block 409. In operation block 409, the parasitic selection logic 210 provides control signals over control lines 208, to switch terminations of one or more parasitic resonators to achieve high correlation and low gain imbalance. The method of operation then ends.

Among other advantages, the above described method of operation is based on the discovery that the prioritization of the antenna FoM changes depending on mobile device operating environment SNR. While the antenna envelope correlation has high priority in high SNR conditions, total efficiency and gain imbalance has very limited impact on MIMO antenna performance. On the other hand, in low SNR conditions, the envelope correlation (also referred to herein as "antenna correlation") has very limited or null impact in MIMO antenna performance while total efficiency and gain imbalance has higher priority. Put another way, different FoM types are dominant depending on operating environment SNR. The dominant FoM type as used herein refers to the FoM type having the largest impact on throughput for the given operating environment SNR.

Therefore, the adaptive parasitic multi-antenna system of the disclosed embodiments changes parasitic resonator configurations as triggered by real time environmental SNR conditions. For high SNR conditions the antenna system parasitic resonators are switched so as to optimize and prioritize low envelope correlation while total efficiency and gain imbalance are de-prioritized. For low SNR conditions the antenna system parasitic resonators are switched so as to optimize and prioritize high total efficiency and low gain imbalance while de-prioritizing a low envelope correlation coefficient. In some embodiments, "low" SNR may be considered to be SNR that is less than about 6 dB. A "high" SNR condition may therefore be considered to be 6 dB and above.

Figure 5:
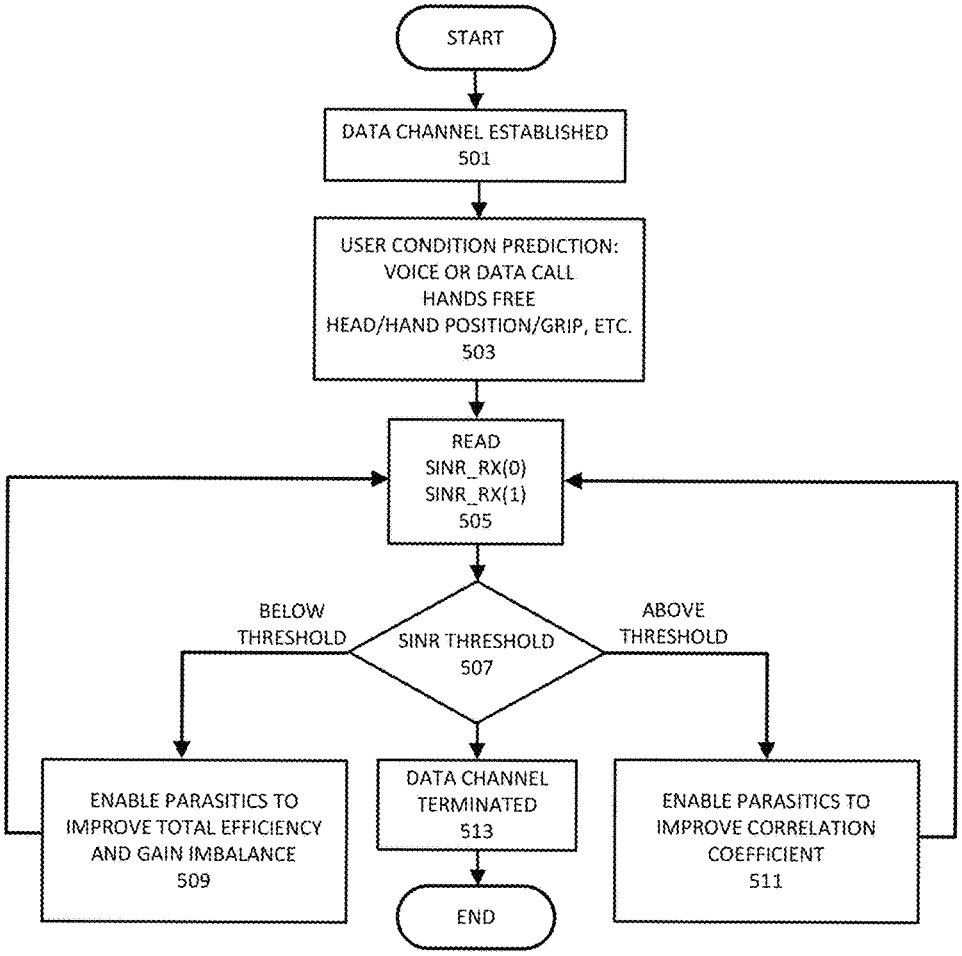
FIG. 5 is a flow chart of an example method of operation of the mobile device shown in FIG. 2 or 3.

Further, in some embodiments, a mobile device may predict the environmental SNR and trigger parasitic resonator configuration adaptation in response to such predictions. The flowchart of FIG. 5 provides an example method of operation for the mobile device 300. The method of operation begins and, in operation block 501, a data channel is established by the transceivers 302. In operation block 503, the condition prediction logic 320 may check the user profile 325 for similar activity by the mobile device 300. The user profile 325 data may include times and dates when voice and data calls were made, the hand grip used (based on data from touch sensors 319), the location, and the SINR measurements obtained for those calls, etc. Based on the user profile 325 data, the condition prediction logic 320 may send an appropriate SNR (or SINR) predict flag to the parasitic selection logic 303 which may then preselect a parasitic resonator configuration.

In operation block 505, the parasitic selection logic 303 measures the real time signal-to-noise-and-interference (SINR) value for each antenna of the MIMO antenna pair. In decision block 507, the parasitic selection logic 303 determines an effective SINR and checks it against a threshold. If the effective SINR is below the threshold, the method of operation proceeds to operation block 509 and the parasitic selection logic 303 selects a parasitic resonator configuration to prioritize total efficiency and gain imbalance (i.e. to obtain low gain imbalance). If however the effective SINR is above the threshold, the method of operation proceeds to operation block 511 and the parasitic selection logic 303 selects a parasitic resonator configuration to prioritize antenna correlation (i.e. to obtain low correlation). In either case, the method of operation loops back to operation block 505 and continues until the data channel is terminated in operation block 513, at which point the method of operation ends.

Figure 6:
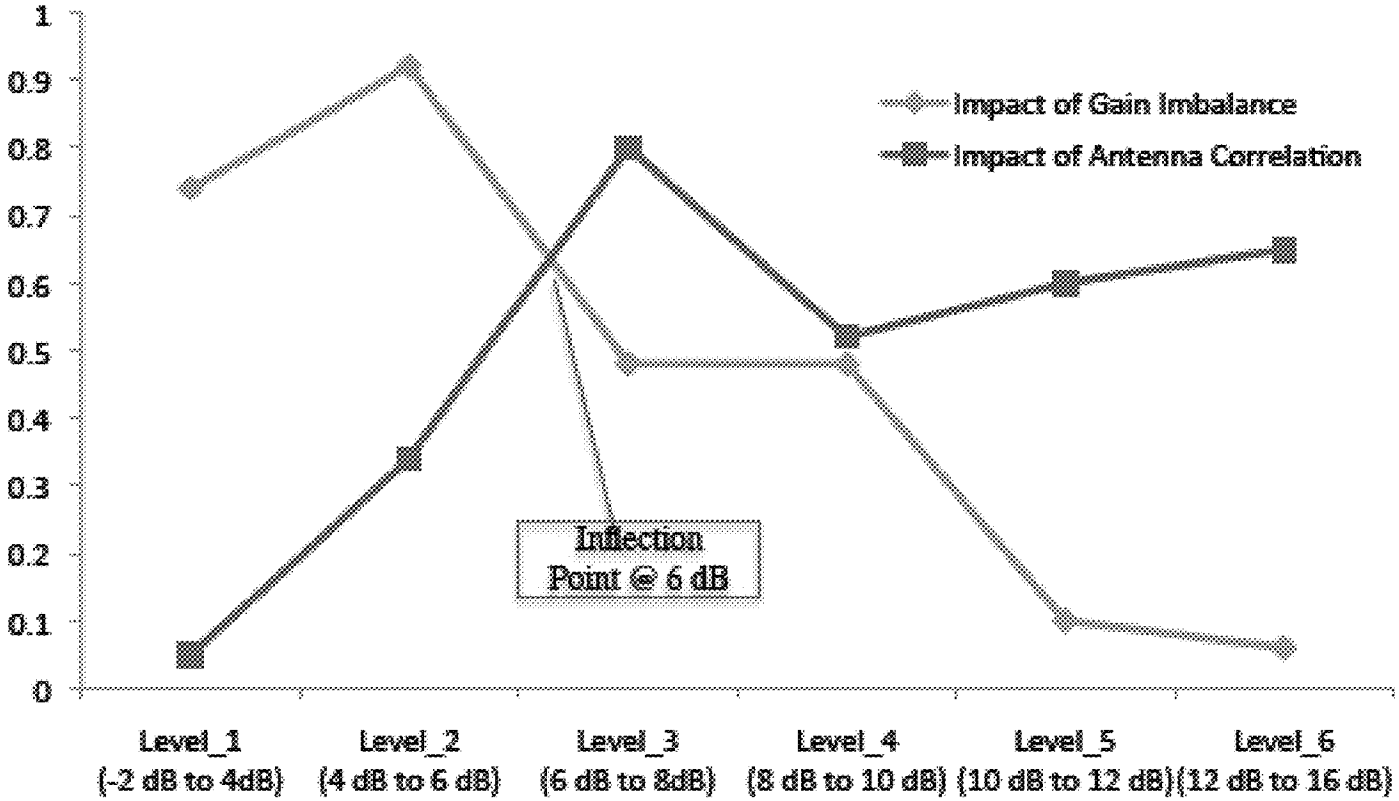
FIG. 6 is an example graph of a relationship that illustrates the impact of gain imbalance and antenna correlation on throughput, versus signal quality as measured by signal-to-noise ratio (SNR) in accordance with various embodiments.

FIG. 6 is an example graph plotting a relationship between gain imbalance and throughput, and between antenna correlation and throughput, versus signal quality as measured by signal-to-noise ratio (SNR) in accordance with various embodiments. It is to be understood that the term SNR as used herein may also refer interchangeably to the term signal-to-noise-plus-interference ratio (SINR). The relationship in the graph of FIG. 6 may be considered as showing a deterministic correlation between gain imbalance and throughput, and between antenna correlation and throughput, versus signal quality as measured by SNR or SINR. The deterministic correlation shown in FIG. 6 was found through empirical data collected using antennas of known antenna correlation. The relationship is considered to be a deterministic correlation, as used herein, in that like empirical data may be collected for any antennas of known antenna correlation to determine an inflection point useful for switching parasitic resonator configurations in order to impact the dominant FoM type for the mobile device's measured environment.

The relationship shown if FIG. 6 may therefore be encoded in the various described parasitic selection logic components in a mobile device for use in making selections of parasitic resonator configurations as described herein. In mobile device 300 shown in the example embodiment of FIG. 3, the relationship shown in FIG. 6 may be encoded and stored in memory 315 for access and use by parasitic selection logic 303. Alternatively, the FIG. 6 relationship may be encoded into parasitic selection logic 303. The encoding may involve providing knowledge of the inflection point such that a threshold is defined (for example, by providing a threshold setting) for use in parasitic resonator selection decisions. The threshold may be defined in software or firmware, or by way of hardwired circuitry or logic circuitry, etc. In the graph of FIG. 6, gain imbalance versus throughput is indicated by diamond shaped data points and antenna correlation coefficient versus throughput is represented by square shaped data points. The vertical axis, or y-axis, represents deterministic correlation and the horizontal axis, or x-axis, represents signal quality as measured by SNR. As can be seen, for an example set of MIMO antennas, an inflection point occurs at about 6 dB. More particularly, FIG. 6 illustrates that the antenna correlation takes on greater significance with respect to throughput than does gain imbalance for SNR levels above 6 dB. Conversely, the gain imbalance exhibits greater significance with respect to throughput for SNR levels below 6 dB. Therefore, this relationship information (i.e. a deterministic correlation) is made use of by parasitic selection logic as described above with respect to the various example embodiments. The threshold setting in the mobile device 300 can be adjusted to various levels depending on the network planning.

Therefore, for SNR values above 6 dB, the parasitic selection logic will select parasitic resonators in order to optimize antenna correlation and, for SNR values below 6 dB the parasitic selection logic will select the parasitic resonators in order to optimize for gain imbalance.

It is to be understood that, although the present disclosure discusses SNR as a signal quality metric used to determine a dominant FoM for an antenna pair, or for an antenna system, SINR ("signal-to-interference-plus-noise-ratio" or "signal-to-noise-plus-interference ratio") may be also be used interchangeably with SNR. In other words, a relationship may be shown between SINR and FoM values and throughput, and therefore an inflection point in such relationship plots may be used as the threshold, as disclosed and described in detail herein, to make parasitic resonator configuration selection decisions to improve throughput under the given environmental conditions (i.e. SINR conditions). The relationship involves a deterministic correlation between SINR and FoM values and throughput which was discovered by analysis of empirically collected data for antennas of known correlation.

Figure 7:
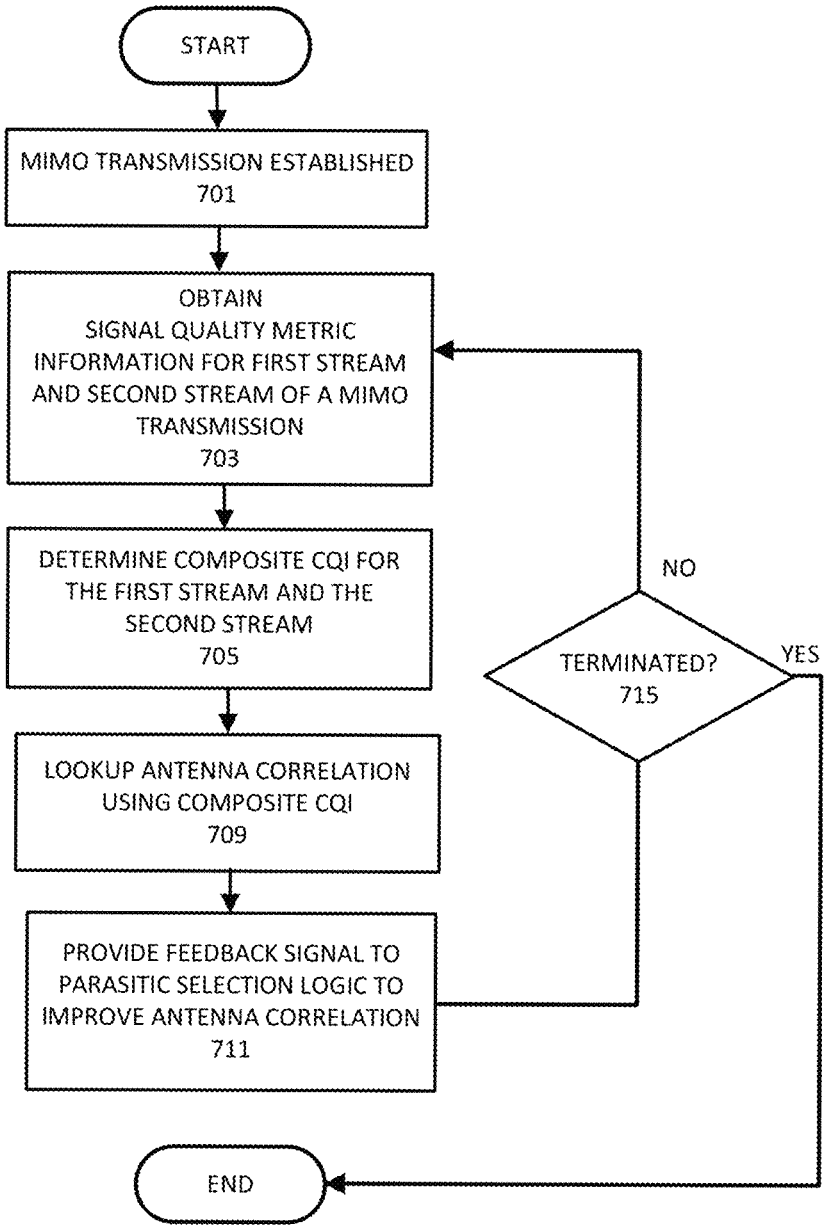
FIG. 7 is a flow chart of an example method of operation of the mobile device in accordance with an embodiment.

FIG. 7 is a flowchart that illustrates a method of operation of the mobile device 100 in accordance with an embodiment. The method of operation begins and, in operation block 701, a MIMO transmission is established that includes a first stream and a second stream such that it is a rank 2 MIMO transmission. In operation block 703, the correlation estimator 360 obtains signal quality metrics (such as SNR and CQI information) from the transceivers 302 for the first stream and for the second stream. Put another way, the signal quality metrics are obtained for a first receiving antenna and a second receiving antenna. In operation block 705, the correlation estimator 360 determines a composite CQI and a percentage utilization of rank 2 transmission by calculating the composite CQI using the SNR and CQI information for each of the two streams. That is, the correlation estimator 360 takes into account a percentage utilization of rank 2 and rank 1 transmissions with respect to the two data streams. The CQI composite is therefore determined using the CQI across both MIMO streams and the MIMO utilization as a percentage of rank 2 and rank 1 utilization. In operation block 709, the correlation estimator 360 accesses a CQI table and performs a table lookup using the composite CQI to obtain an estimated antenna correlation. In accordance with the embodiments, the CQI table is predetermined using empirical data collected from known antennas of known correlation. The CQI table defined by the LTE specifications is modified in the present embodiments to provide a composite CQI metric for a corresponding channel-0 and channel-1 CQI for the two streams. In operation block 711, the estimated correlation may be used to generate a feedback signal to the parasitic selection logic 303 so as to engage one or more parasitic resonators in order to improve (i.e. lower) the antenna correlation accordingly. The method of operation may continue to loop back to operation block 703 until the MIMO transmission is terminated in decision block 715.

In accordance with the embodiments, the correlation estimator 360 generates a metric referred to herein as the "MIMO conditioner" metric which quantifies the changes in antenna correlation due to changes in the mobile device 300 environment including changes in modality. This metric is generated by using filtered values. The MIMO conditioner metric may be further used to generate the feedback signal to the parasitic selection logic 303.

Figure 10:
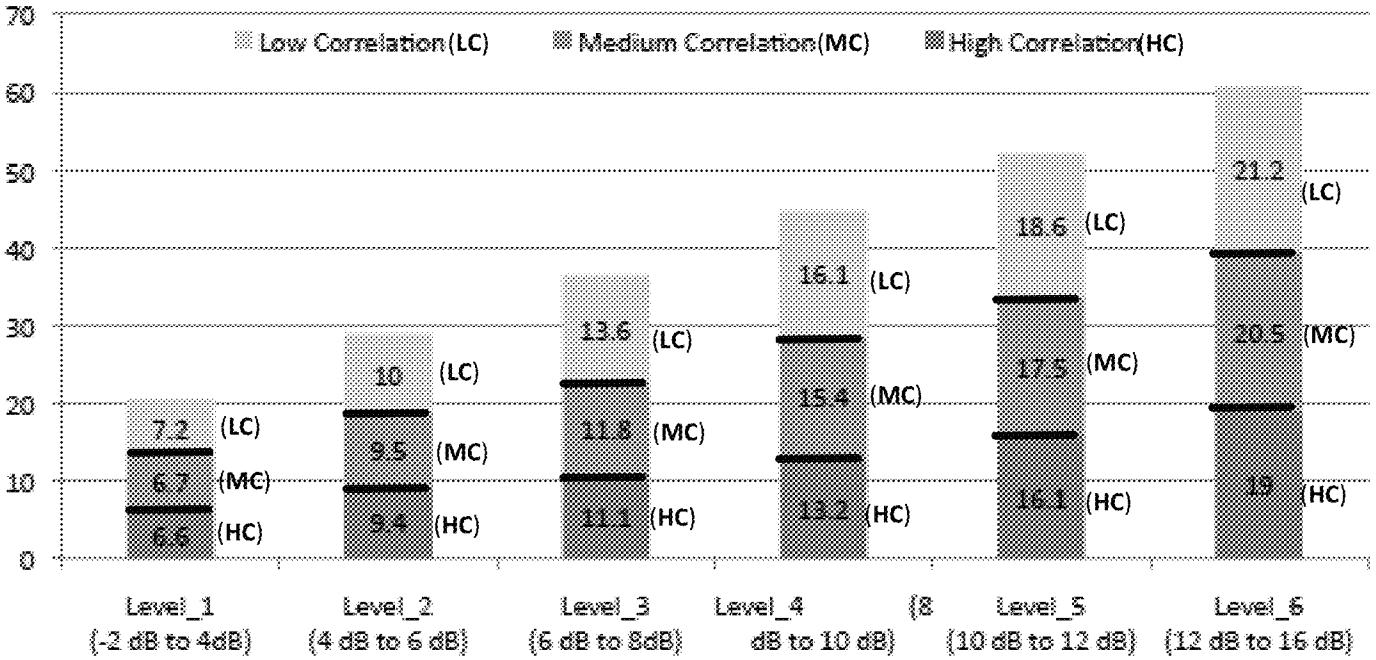
FIG. 10 is a bar chart showing SNR quantization levels with respect to antenna correlation.

The relationships used by the correlation estimator 360 have been determined through empirical measurements. More specifically, various reference antennas with known correlation have been measured in a MIMO test chamber using a channel model reflective of real-world conditions. For example, an employed test environment was Multi Probe Anechoic Chamber (MPAC) Band 13, DL EARFCN-5230 (EUTRA Absolute Radio Frequency Channel) using 3GPP LTE Transmission Mode-4 (Closed Loop Spatial Multiplexing) and using the 3GPP SCME Uma channel model. Various signal levels were then selected as reference points to compare various reference antennas with correlations of 0.1, 0.5 and 0.9. It was found that MIMO performance was highly statistically correlated with SINR and therefore SINR was bucketized/quantized into six levels which are illustrated in FIG. 6, FIG. 10 and FIG. 11. For the test channel model, the maximum observed SINR was approximately 18 dB. For a MIMO spatial multiplexing system, the antenna correlation is important toward determining an overall channel quality score, and CQI takes into account both SINR and antenna correlation. FIG. 6 illustrates that for an antenna system with high efficiency but poor antenna correlation (i.e. high correlation) the gains in SINR do not translate to high CQI.

Figure 9:
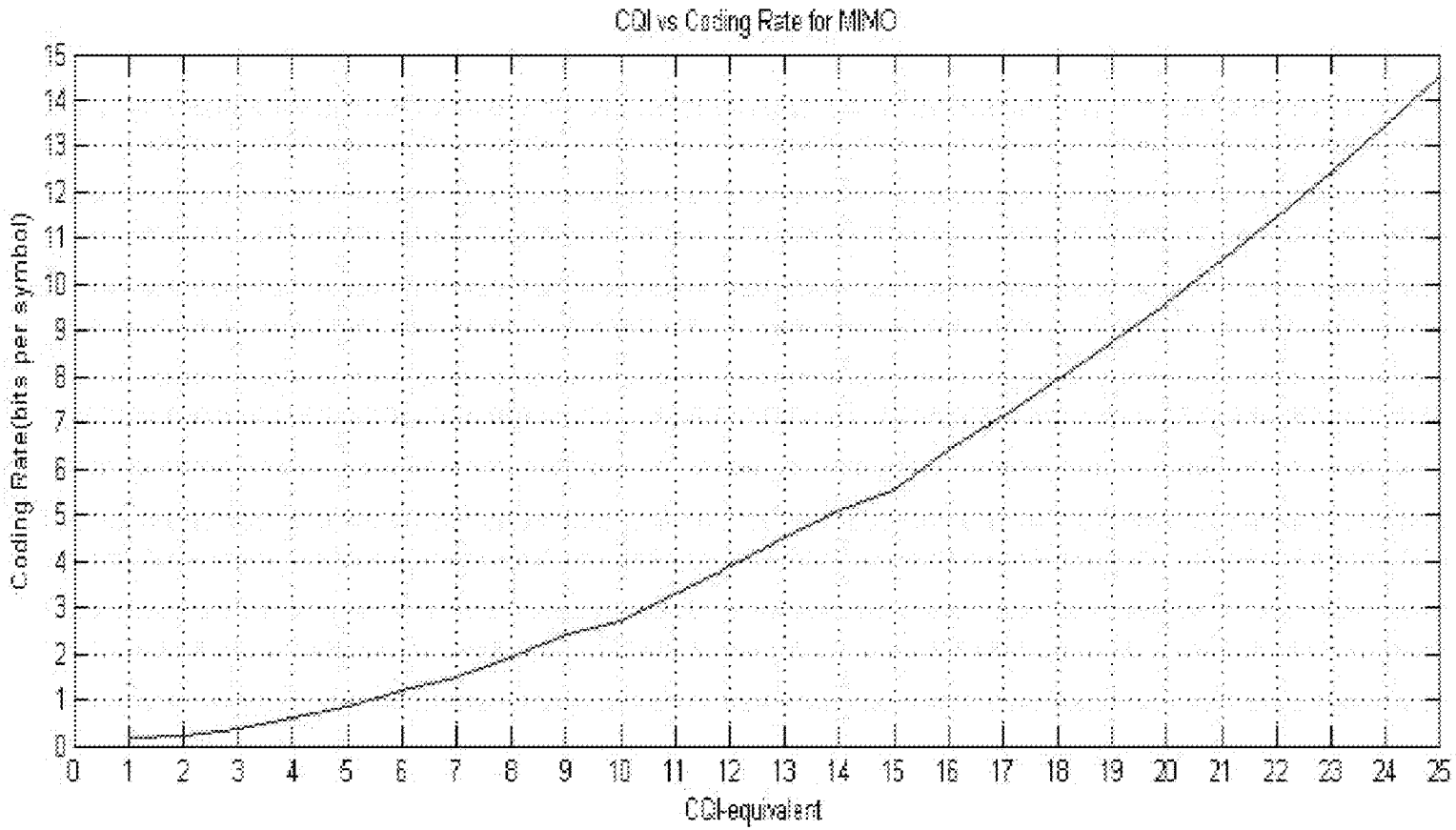
FIG. 9 is a graph of equivalent CQI versus coding rate for a MIMO rank 2 transmission in accordance with the embodiments.

As known by those of ordinary skill, standards map CQI to coding rate. The 3GPP TS 36.213 V12.1.0 (2014 March); 3rd Generation Partnership Project; Technical Specification Group Radio Access Network; Evolved Universal Terrestrial Radio Access (E-UTRA); Physical layer procedures (Release 12) (2014), which is hereby incorporated by reference herein, defines the "Channel Quality Indicator (CQI)" and provides a table mapping CQI index to coding rate for a SISO (Single-Input Single Output) system. In accordance with the embodiments, FIG. 9 is a mapping adapted to a rank 2 MIMO transmission and therefore represents the composite CQI described above. The coding rates translate to throughput in bits-per-symbol (bps). The bar graph in FIG. 10 illustrates percentage antenna correlation based on the combined CQI for the various quantized SINR levels (level 1 through level 6) for a "low," "medium," and "high" antenna correlations such as, for example, may be attributed to the tested reference antennas with correlations of 0.1, 0.5 and 0.9. An example lookup table is shown in FIG. 11. By using a calculated percentage value and locating the appropriate SNR quantization level based on the measured SNR, the estimated antenna correlation may be obtained. For example, 97.5% at level 2 SNR implicates an antenna correlation estimate of 0.3.

Figure 8:
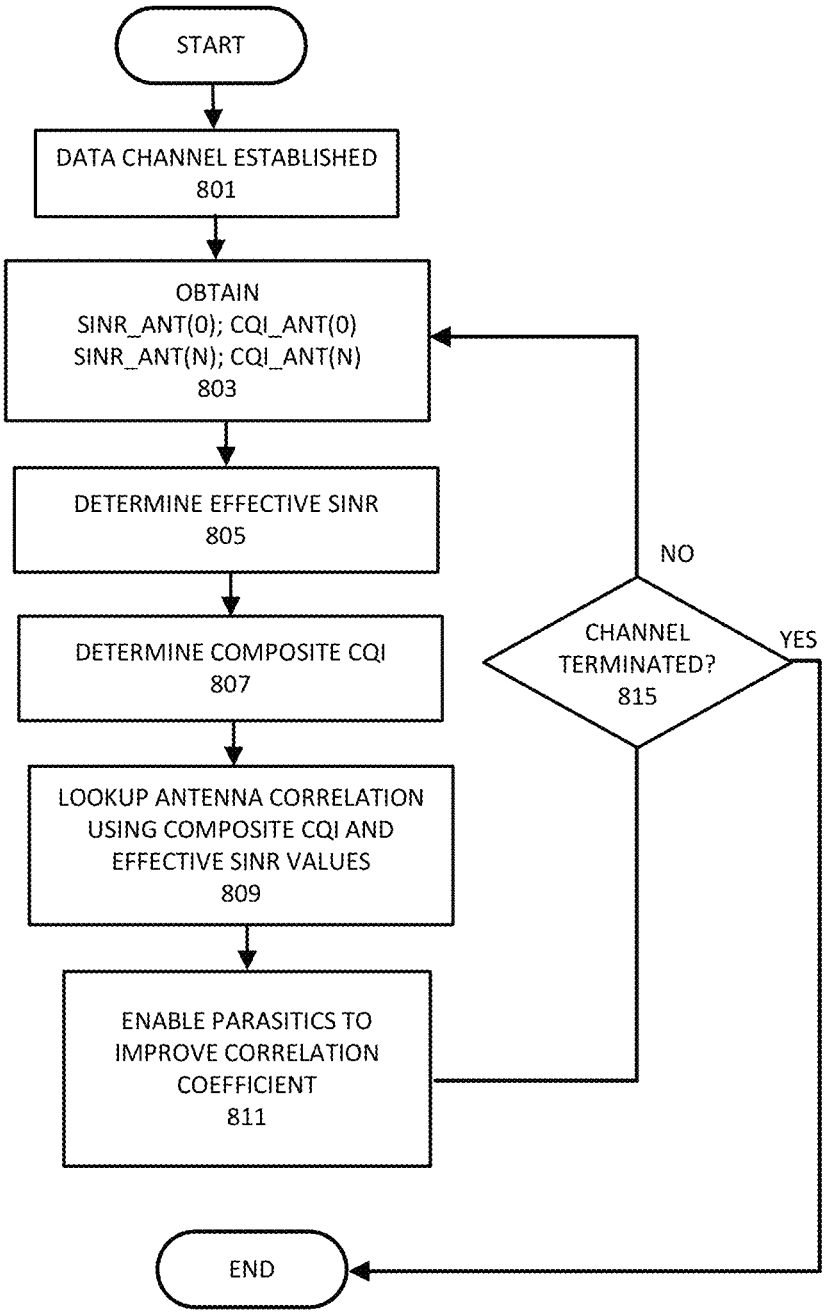
FIG. 8 is a flow chart of an example method of operation of a mobile device in accordance with the embodiment.

The flowchart of FIG. 8 provides further details of a method of operation for determining a MIMO conditioner metric in accordance with the embodiments. The MIMO conditioner metric is used to map the equivalent CQI (composite CQI) to an approximate correlation value with, for example, a resolution of 1/10 (0.1). A data channel is established in operation block 801 and in operation block 803, the correlation estimator 360 obtains SNR and CQI information for two streams on any two antennas of MIMO antenna system 307 that are operating, for example Ant0 and Ant1. In operation block 805, one second averaged samples of SNR-Ant0, SNR-Ant1 are calculated. From the empirical data and statistical correlation estimates, weighting factors are generated for SNR per antenna. The effective SNR may then be calculated as for example, if one MIMO antenna is represented by "Ant0" and another MIMO antenna is represented by "Ant1," then an effective SINR may be calculated as: SINReff=[(wt1×SINR(ant0))+(wt2×SINR(ant1))]; where "wt1" and "wt2" are weighting factors calculated by statistical correlation of SINR(Ant0) to effective CQI (channel quality indicator) and SINR(Ant1) to effective CQI using empirical data collected using reference MIMO antennas with known antenna correlation. One specific example is Effective SNR=(0.94*SNR-Ant0+0.95*SNR-Ant1)/2.

The correlation estimator 360 also calculates one second averaged gain imbalance between the two MIMO antennas such that Gain_Imb=RSSI_Ant0−RSSI_Ant1. In operation block 807, for CQI-CW1 (second channel), all zeroes are averaged in as well to account for the cases when rank 1 (single stream or channel) MIMO is active. Thus CQI-CW0 and CQI-CW1 are calculated. The equivalent CQI-composite is calculated from the CQI-CW0 and CQI-CW1. As mentioned above, FIG. 9 is an extension of the standard table and accommodates rank 2 cases to create a composite CQI value which encodes rank utilization (cases where rank 1 and rank 2 co-exist). Thus the correlation estimator 360 performs a lookup in operation block 809, i.e. CQI-composite=lookup(CQI-CW0, CQI-CW1).

The correlation estimator 360 may then generate the MIMO-conditioner metric as (CQI-composite/CQI-target) *100. The CQI-target for an SNR_quantization level is calculated as the channel quality determined by the antenna with least correlation of 0.1. The MIMO-conditioner metric is then used to find the correlation per FIG. 11.

In FIG. 10, the SNR quantization level (2-dB steps) is checked and the CQI-composite-ref value is checked for each of reference antennas {high, medium, low}. The MIMO-conditioner metric is generated using the CQI-composite-ref-low-correlation (divided by) the CQI-composite-device. This is done because the mobile device most typically has much higher correlation than the CQI-composite-ref for the low-correlation reference antenna. Therefore the value is between 0 and 1. The MIMO conditioner metric is also available for the high correlation and medium correlation reference antenna. The percentage deltas between the values will estimate the approximate antenna correlation of the mobile device. For example, if the CQI-Composite-low-correlation=16.1, the MIMO-conditioners for medium and high correlation antennas are 0.96 (15.4) and 0.82 (11.1), and CQI-Composite-device is at 13.4, then the MIMO-conditioner of the mobile device is at 0.84. This indicates that the antenna correlation is about 0.82. The exact quantification can be facilitated by linear interpolation between the points. This can be used in operation block 811 to provide feedback to the parasitic selection logic 303. The method may continue to loop to operation block 803 and make adjustments as needed until the channel is terminated in decision block 815.

Therefore the MIMO-conditioner metric described herein is the quantification of the approximate antenna correlation of the mobile device. This quantification is related to the modality of the mobile device such as hand-grips of a specific user, dock mode or other detectible conditions that may be detected using various sensors. In addition, the MIMO-conditioner can also be related to the geo-location of the mobile device. In some embodiments, mobile devices may use location information from the location detection logic 309 and generate geo-tagged MIMO conditioner values at various locations that are stored in a user profile for storage and aggregation.

Figure 12:
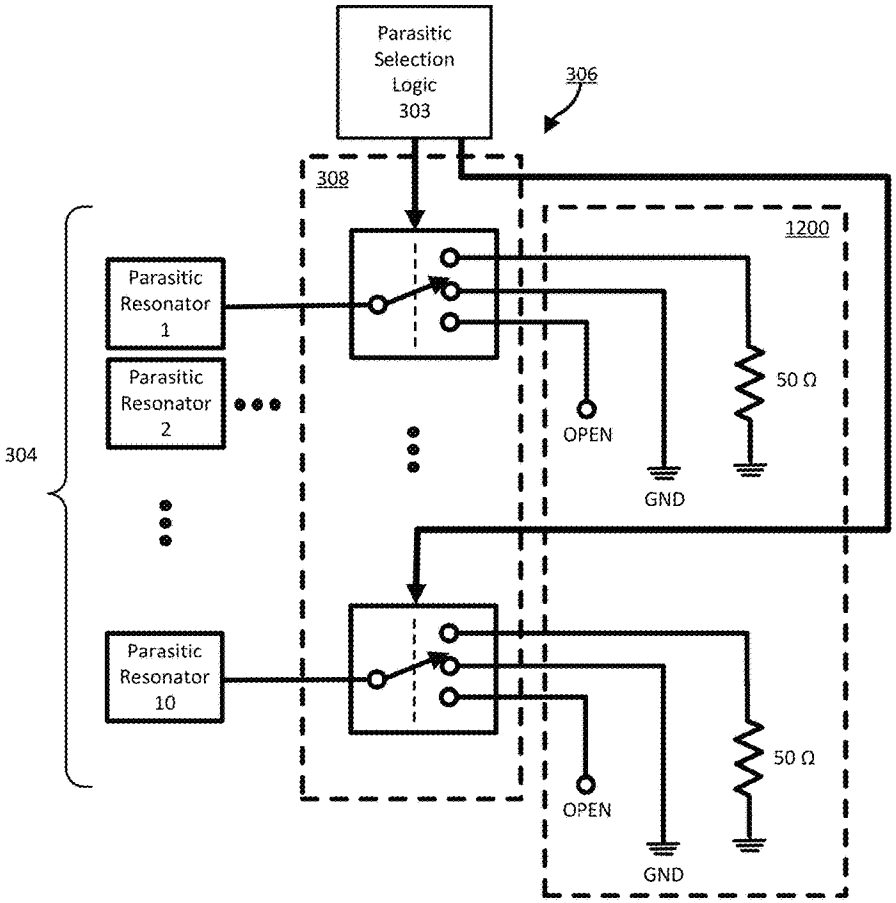
FIG. 12 is a diagram showing an example of parasitic resonator control coupling and corresponding terminations in accordance with one embodiment.

The diagram of FIG. 12 provides an example of the control coupling 306 between the parasitic selection logic 303 and the parasitic resonators 304 in accordance with one embodiment. The parasitic resonators 304 are each individually operatively coupled to a set of terminations in a termination array 1200 by a termination switch. The termination switches may be part of a termination switching matrix 308 that is operatively coupled to the parasitic selection logic 303, or may be integrated with the parasitic selection logic 303 in some embodiments. Each termination switch may be a single-pole multi-throw switch as shown, where each output ports is operatively coupled to a termination of a given impedance such as, open circuit, short-circuit (i.e. grounded), 50 Ohm, or some other Ohm value termination. Although the example switches shown in FIG. 12 have three output terminals, the switches may have any number of output terminal such that various terminations may be used in addition to open, shorted and 50 Ohm, etc.

The parasitic selection logic 303 is operative to control each termination switch of the termination switching matrix 308 individually, such that specific parasitic resonators (of parasitic resonators 1 through 10) may be terminated with a specific termination. Although the example embodiments discussed thus far have shown ten parasitic resonators, a lesser or greater number of parasitic resonators may be used in the various embodiments and the examples provided herein are not to be viewed as limiting. The termination switches may be implemented using any suitable technology, such as, but not limited to, CMOS FETs, bipolar junction transistors, mechanical switches, FPGAs, etc., without limitation in the various embodiments.

Parasitic resonator configurations may be formed using the termination switches and the termination array 1200 but switching each of the parasitic resonators to given terminations in response to measured or predicted environmental conditions as discussed above. The feedback mechanisms discussed above enable the parasitic selection logic 303 to adaptively adjust the parasitic resonator 304 configuration to impact antenna correlation or gain imbalance in response to measured conditions so as to obtain the best possible MIMO antenna pair performance for given conditions.

Although the example shown in FIG. 12 is a single set of parasitic resonators 304, some embodiments may employ multiple sets of parasitic resonators in which there is a set of parasitic resonators for each operating band of the mobile device. In such embodiments, the switching matrix 308 may utilize the same termination array 1200 by switching to the other bands parasitic resonator set, using for example, multi-pole, multi-throw switches or equivalents. In one example, a four band MIMO mobile device may have one or more parasitic resonators for each of the four bands, where each resonator has three or more switchable terminations.

The parasitic resonators may be implemented using unconnected (i.e. not electrically driven) antenna elements (i.e. passive radiators), such as, but not limited to microstrip elements (in some embodiments), etc. and may include lumped circuit elements operatively coupled to the passive radiators in some embodiments, such as lumped reactive components that form resonant circuits in conjunction with the passive radiators, etc., in order to achieve resonance at desired frequencies or within desired frequency bands.

While various embodiments have been illustrated and described, it is to be understood that the invention is not so limited. Numerous modifications, changes, variations, substitutions and equivalents will occur to those skilled in the art without departing from the scope of the present invention as defined by the appended claims.

What is claimed is:

1. An apparatus comprising:

a first antenna and a second antenna, operatively coupled to a transceiver;

a set of parasitic resonators distributed about the apparatus; and parasitic selection logic, operatively coupled to the set of parasitic resonators and to the transceiver, the parasitic selection logic operative to:

determine a signal quality metric using a first signal quality metric measurement for the first antenna, and a second signal quality metric measurement for the second antenna;

determine a dominant figure-of-merit for the first antenna and the second antenna, the dominant figure-of-merit determined from at least two figure-of-merit types related to performance of the first antenna when paired with the second antenna, and further based on the signal quality metric's relation to an inflection point in a relationship of signal-to-noise ratio and data throughput to the figure-of-merit types, wherein signal-to-noise ratio above the inflection point indicates configuration of the set of parasitic resonators such that the first antenna and the second antenna, when paired, have a first figure-of-merit type as the dominant figure-of-merit and wherein signal-to-noise ratio below the inflection point indicates configuration of the set of parasitic resonators such that the first antenna and the second antenna, when paired, have a second figure-of-merit type as the dominant figure-of-merit; and configure the set of parasitic resonators such that each parasitic resonator is coupled to a corresponding termination in response to the determined signal quality metric to obtain the dominant figure-of-merit, in response to the signal quality metric's relationship to the at least two figure-of-merit types.

2. The apparatus of claim 1, further comprising:

a termination matrix, operatively coupled to the parasitic selection logic, the termination matrix comprising termination sets where each termination set corresponds to a parasitic resonator in the set of parasitic resonators; and wherein the parasitic selection logic is operative to switch each parasitic resonator to a specific termination of a corresponding termination set in response to the determined signal quality metric.

3. The apparatus of claim 2, further comprising:

a termination switching matrix, operatively coupled to the termination matrix; and wherein the parasitic selection logic is operative to control the termination switching matrix to switch each individual parasitic resonator, of the set of parasitic resonators, to a specific termination of a corresponding termination set in response to the determined signal quality metric.

4. The apparatus of claim 3, wherein the termination switching matrix is operatively coupled to the parasitic selection logic.

5. The apparatus of claim 3, wherein the parasitic selection logic comprises the termination switching matrix.

6. The apparatus of claim 3, wherein each termination set of the termination switching matrix comprises:

an open circuit termination, a short circuit termination, and at least one termination of known impedance.

7. The apparatus of claim 6, wherein the at least one termination of known impedance is a fifty Ohm termination.

8. The apparatus of claim 1, wherein the parasitic selectin logic is operative to configure the set of parasitic resonators, by:

switching at least one of the parasitic resonators to a termination such that the first antenna and the second antenna have a lower antenna correlation when antenna correlation is the dominant figure of merit; and switching at least one of the parasitic resonators to a termination such that the first antenna and the second antenna have a lower gain imbalance when gain imbalance is the dominant figure of merit.

9. The apparatus of claim 1, wherein the parasitic selectin logic is further operative to:

determine that antenna correlation is the dominant figure-of-merit when the signal quality metric is above the inflection point; and determine that gain imbalance is the dominant figure-of-merit when the signal quality metric is below the inflection point.

10. The apparatus of claim 1, wherein the parasitic selectin logic is further operative to:

calculate the signal quality metric using signal-to-noise ratios obtained for each antenna.

11. The apparatus of claim 1, further comprising:

condition prediction logic, operatively couple to the parasitic selection logic;

wherein the parasitic selectin logic is further operative to:

obtain a prediction of the signal quality metric from the condition prediction logic, based on a user history; and preselect a parasitic resonator configuration in response to the prediction.

12. An apparatus comprising:

a first antenna and a second antenna, operatively coupled to a transceiver;

a set of parasitic resonators distributed about the apparatus; and a correlation estimator, operatively coupled to the transceiver, the correlation estimator operative to:

obtain a channel quality indicator (CQI) measurement for the first antenna and the second antenna;

determine a composite CQI for the two antennas; and estimate the antenna correlation for the first antenna and second antenna using the composite CQI by performing a table lookup in a CQI table using the composite CQI;

parasitic selection logic, operatively coupled to the set of parasitic resonators, to the correlation estimator and to the transceiver, the parasitic selection logic operative to:

determine a signal quality metric using a first signal quality metric measurement for the first antenna, and a second signal quality metric measurement for the second antenna; and configure the set of parasitic resonators such that each parasitic resonator is coupled to a corresponding termination in response to the determined signal quality metric, and in response to the estimated antenna correlation; and non-volatile, non-transitory memory, operatively coupled to the correlation estimator, storing the CQI table mapping composite CQI comprising at least a first and second multiple input multiple output (MIMO) stream to coding rates.

13. The apparatus of claim 12, wherein the correlation estimator is further operative to:

obtain a signal-to-noise ratio (SNR) measurement for the first antenna and the second antenna; and estimate the antenna correlation for the first antenna and second antenna using the composite CQI and the SNR measurement.

14. The apparatus of claim 12, wherein the correlation estimator is further operative to:

provide a feedback signal to parasitic selection logic based on the estimated antenna correlation.

15. The apparatus of claim 14, wherein the parasitic selection logic is operative to:

configure the set of parasitic resonators, in response to the feedback signal.

* * * * *